US008235174B1

(12) United States Patent
Pelini

(10) Patent No.: US 8,235,174 B1
(45) Date of Patent: Aug. 7, 2012

(54) JACK PLATE LADDER

(76) Inventor: Mark F. Pelini, Valrico, FL (US)

( * ) Notice: Subject to any disclaimer, the term of this patent is extended or adjusted under 35 U.S.C. 154(b) by 478 days.

(21) Appl. No.: 12/586,556

(22) Filed: Sep. 24, 2009

(51) Int. Cl.
*E04G 3/00* (2006.01)

(52) U.S. Cl. ..... 182/93; 182/82; 182/83; 182/85; 182/100; 114/362

(58) Field of Classification Search ..... 182/82, 182/83, 85, 87, 93, 100, 107; 114/362
See application file for complete search history.

(56) References Cited

U.S. PATENT DOCUMENTS

| | | | | | |
|---|---|---|---|---|---|
| 372,982 | A * | 11/1887 | Judd | 182/93 |
| 3,762,500 | A * | 10/1973 | Sarno | 182/93 |
| 3,786,899 | A * | 1/1974 | Zenhausern | 182/93 |
| 3,869,742 | A * | 3/1975 | Gale et al. | 114/362 |
| 4,067,412 | A * | 1/1978 | Jackson | 182/93 |
| 4,146,941 | A * | 4/1979 | Haslam | 114/362 |
| 4,355,701 | A * | 10/1982 | Nicholson | 182/97 |
| 4,432,436 | A * | 2/1984 | Suiter | 182/97 |
| 4,892,170 | A * | 1/1990 | O'Donnell | 182/100 |
| 5,014,640 | A * | 5/1991 | Owen, Sr. | 114/362 |
| 5,113,782 | A * | 5/1992 | McCarty | 114/362 |
| 5,222,456 | A * | 6/1993 | Friedrich | 114/362 |
| 5,515,806 | A * | 5/1996 | McCabe | 114/362 |
| 5,964,317 | A * | 10/1999 | Lattavo | 182/127 |
| 6,003,633 | A * | 12/1999 | Rolson | 182/127 |
| 6,029,774 | A * | 2/2000 | Cothern | 182/107 |
| 6,360,845 | B1 * | 3/2002 | Allison | 182/107 |
| 6,932,021 | B1 * | 8/2005 | Martini | 114/362 |
| 6,932,193 | B2 * | 8/2005 | Tombarello | 182/93 |
| 6,945,189 | B1 * | 9/2005 | Garelick et al. | 114/362 |
| 8,006,803 | B2 * | 8/2011 | Guering | 182/100 |
| 2007/0095609 | A1 * | 5/2007 | Grundler | 182/93 |
| 2007/0095610 | A1 * | 5/2007 | Grundler | 182/93 |
| 2008/0105190 | A1 * | 5/2008 | Garelick | 114/362 |
| 2011/0011675 | A1 * | 1/2011 | Ebbenga et al. | 182/106 |

* cited by examiner

*Primary Examiner* — Katherine W Mitchell
*Assistant Examiner* — Colleen M Chavchavadze
(74) *Attorney, Agent, or Firm* — Edward P. Dutkiewicz

(57) ABSTRACT

A jack plate ladder comprises a jack plate mount having a ladder groove, a pair of threaded ladder mount bolt holes, and a pair of threaded plate mounting holes. A ladder containment piece is coupled by a plurality of ladder mount bolts to the jack plate mount and forms a generally rectilinear ladder aperture there through the jack plate mount. A ladder has a central shaft and a pair of steps, the ladder being contained with the ladder aperture.

4 Claims, 3 Drawing Sheets

FIG 3
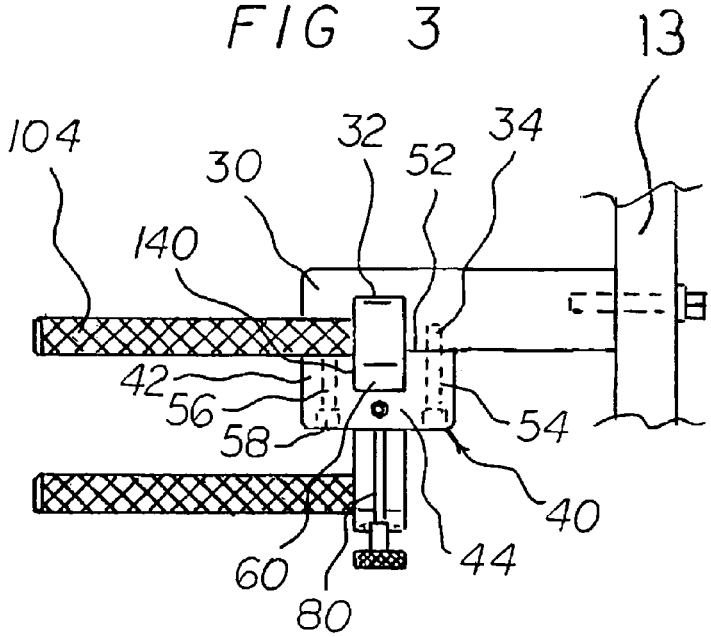
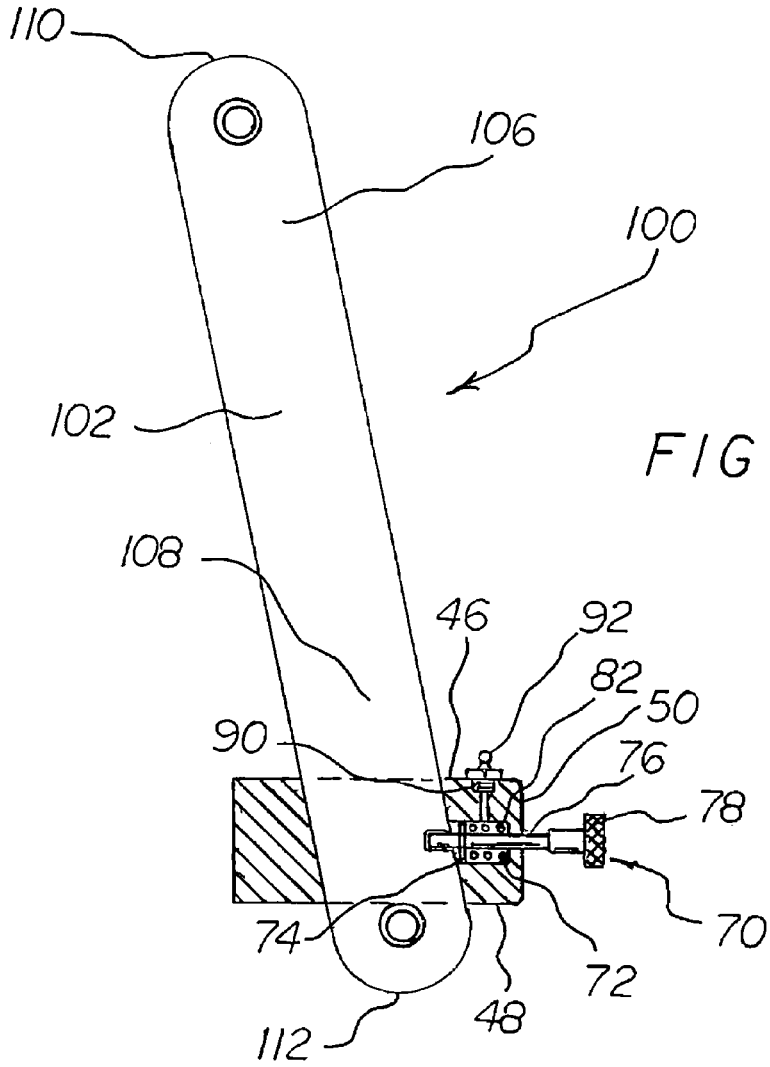
FIG 4

JACK PLATE LADDER

BACKGROUND OF THE INVENTION

Rule 1.78(F)(1) Disclosure

The Applicant has not submitted a related pending or patented non-provisional application within two months of the filing date of this present application. The invention is made by a single inventor, so there are no other inventors to be disclosed. This application is not under assignment to any other person or entity at this time.

FIELD OF THE INVENTION

The present invention relates to a jack plate ladder and more particularly pertains to a ladder which is mountable on a jack plate of a boat.

DESCRIPTION OF THE PRIOR ART

The use of ladders to enable swimmers to climb into a boat is known in the prior art. More specifically, ladders to enable swimmers to climb into a boat previously devised and utilized for the purpose of ingress and egress of a boat are known to consist basically of familiar, expected, and obvious structural configurations, notwithstanding the myriad of designs encompassed by the crowded prior art which has been developed for the fulfillment of countless objectives and requirements.

While the prior art devices fulfill their respective, particular objectives and requirements, the aforementioned patents do not describe jack plate ladder that is mountable on a jack plate.

In this respect, the jack plate ladder according to the present invention substantially departs from the conventional concepts and designs of the prior art, and in doing so provides an apparatus primarily developed for the purpose of mounting a ladder on a jack plate.

Therefore, it can be appreciated that there exists a continuing need for a new and improved jack plate ladder which can be mounted on a jack plate. In this regard, the present invention substantially fulfills this need.

SUMMARY OF THE INVENTION

In view of the foregoing disadvantages inherent in the known types of ladders to enable swimmers to climb into a boat now present in the prior art, the present invention provides an improved jack plate ladder. As such, the general purpose of the present invention, which will be described subsequently in greater detail, is to provide a new and improved jack plate ladder which has all the advantages of the prior art and none of the disadvantages.

To attain this, the present invention essentially comprises a jack plate ladder comprising several components, in combination.

First provided is a jack plate mount. The jack plate mount is fabricated of a rigid material. The jack plate mount has a plate end and a ladder mount end. The plate end has a solid rectilinear configuration with a generally rectilinear cross sectional configuration. The plate end has an outermost extent, with the outermost extent having a plurality of threaded bolt holes there in. The bolt holes each have an associated bolt and lock washer there with.

The ladder end is continuous with the plate end of the jack plate mount. The ladder end has an outermost extent, with the extent comprising a generally rectilinear solid shaft having a ladder groove therein. The ladder end has a pair of threaded ladder mount bolt holes there in.

There is provided a ladder containment piece. The containment piece has a generally C-shaped configuration, with two short legs each having a first length and a connector having a second length there between. The short legs of the ladder containment are shorter than the connector second length. The ladder containment piece has an upper surface, a lower surface, and a side surface there between. The ladder containment piece also has an inner surface. The side surface of the ladder containment piece has a pair of ladder mount bolt holes there through.

The ladder mount bolt holes run from the side surface of the containment, through the length of the short legs of the containment, to the inner surface of the containment. Each ladder mount bolt hole has an associated ladder mount bolt and an associated lock washer.

The ladder end and the ladder containment are coupled by the ladder mount bolts, thereby forming a generally rectilinear ladder aperture through the ladder end of the jack plate mount.

The containment has an associated lock pin. The lock pin having an associated biasing spring, spring stop, and spring stop pin. The lock pin has a shaft and a knurled gripping knob. The containment has a lock pin aperture there through. The lock pin aperture has an associated spring recess located on the inner surface of the containment. The lock pin aperture runs from the side surface of the containment to the inner surface of the containment, with the lock pin passing through the lock pin aperture.

The containment also has a threaded grease fitting hole located on the upper surface of the containment. The grease fitting hole passes from the upper surface of the containment to the lock pin aperture. The grease fitting hole has an associated grease fitting coupled there to.

There is provided a ladder. The ladder is fabricated of a rigid material. The ladder having a central shaft and a pair of steps. The central shaft has a generally rectilinear configuration, with an upper end and a lower end. The upper end an upper extent and a lower end has a lower extent. The upper end has a step bolt hole there through. The lower end has a step bolt hole there through. The steps each have a generally round tubular construction, with each step having an outer end and an inner end. The outer end of the step has an outer extent and the inner end of the step has an inner extent. The inner extent of each of the steps has a threaded bolt hole there in. Each step has an associated coupling bolt and lock washer. The steps each operatively couple to the ladder central shaft.

The central shaft of the ladder passes through and is contained within the ladder aperture formed by the mount end and ladder containment piece. The lower end of the ladder central shaft has a lock pin recess therein. The lock pin recess engages the lock pin and maintains the ladder in an upwardly displaced and stored orientation. The pulling of the lock pin by the user allows the ladder to fall downward, through the ladder aperture, to a downward, deployed position.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved jack plate ladder which has all of the advantages of the prior art ladders, that is, to enable swimmers to climb into a boat, and none of the disadvantages.

It is another object of the present invention to provide a new and improved jack plate ladder which may be easily and efficiently manufactured and marketed.

It is further object of the present invention to provide a new and improved jack plate ladder which is of durable and reliable constructions.

An even further object of the present invention is to provide a new and improved jack plate ladder which is susceptible of a low cost of manufacture with regard to both materials and labor, and which accordingly is then susceptible of low prices of sale to the consuming public, thereby making such jack plate ladders economically available to the buying public.

Even still another object of the present invention is to provide a jack plate ladder which is mountable on a jack plate.

Lastly, it is an object of the present invention to provide a new and improved jack plate ladder comprising a jack plate mount having a ladder groove, a pair of threaded ladder mount bolt holes, and a pair of threaded plate mounting holes. A ladder containment piece is coupled by a plurality of ladder mount bolts to the jack plate mount and forms a generally rectilinear ladder aperture there through the jack plate mount. A ladder has a central shaft and a pair of steps, the ladder being contained with the ladder aperture.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is view taken along line 3-3 of FIG. 2.

FIG. 4 is a view taken along line 4-4 of FIG. 1.

The same reference numerals refer to the same parts throughout the various Figures.

DESCRIPTION OF THE PREFERRED EMBODIMENT

Figure 1:
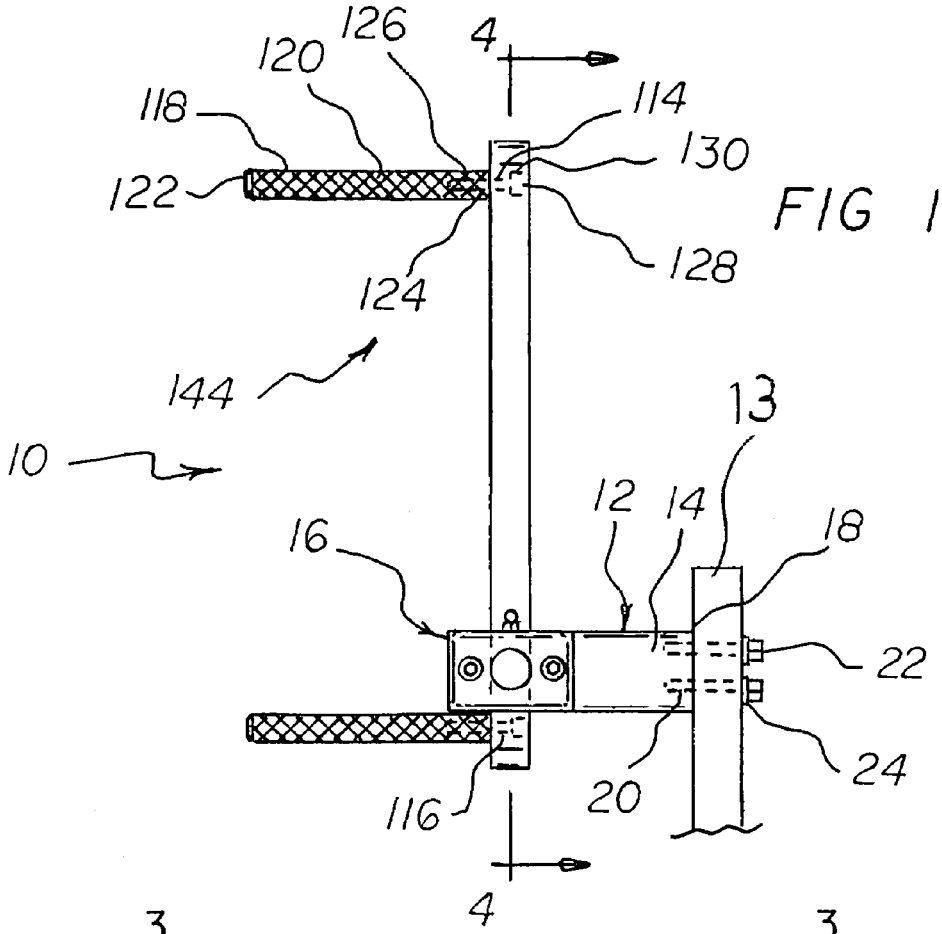
FIG. 1 is a side view of the jack plate ladder, with the ladder in the up and stored, or non-deployed configuration.
Figure 2:
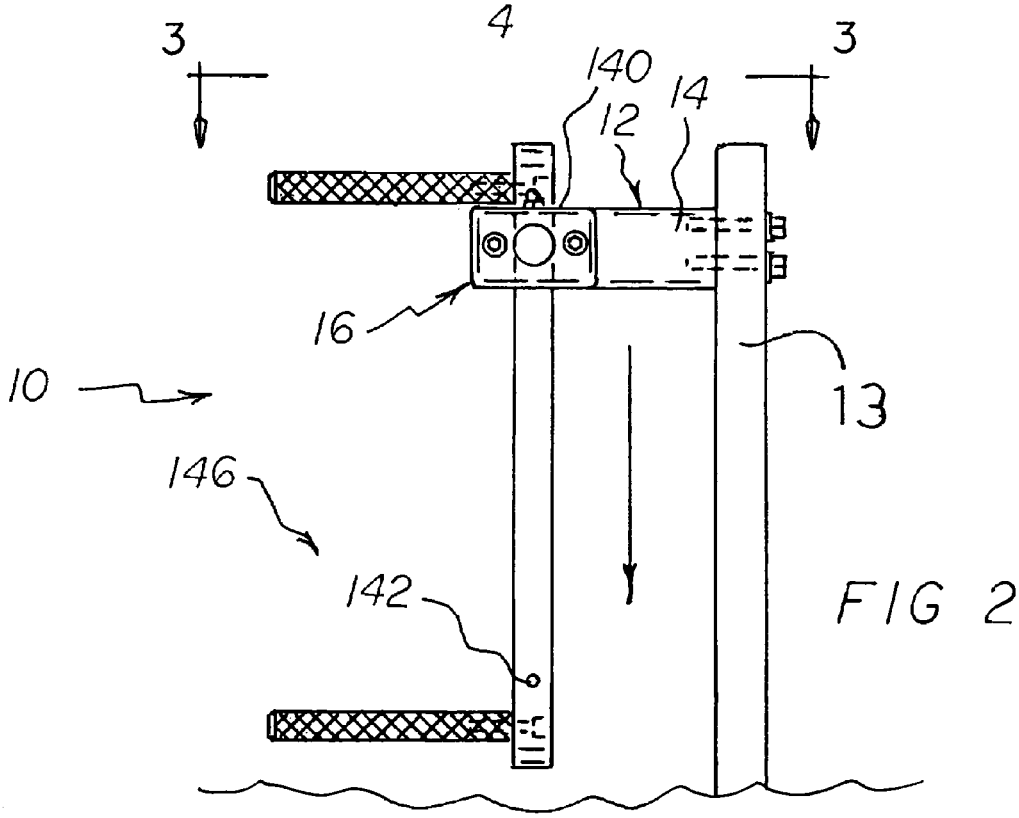
FIG. 2 is a side view of the jack plate ladder, with the ladder in the down and deployed configuration.
Figure 5:
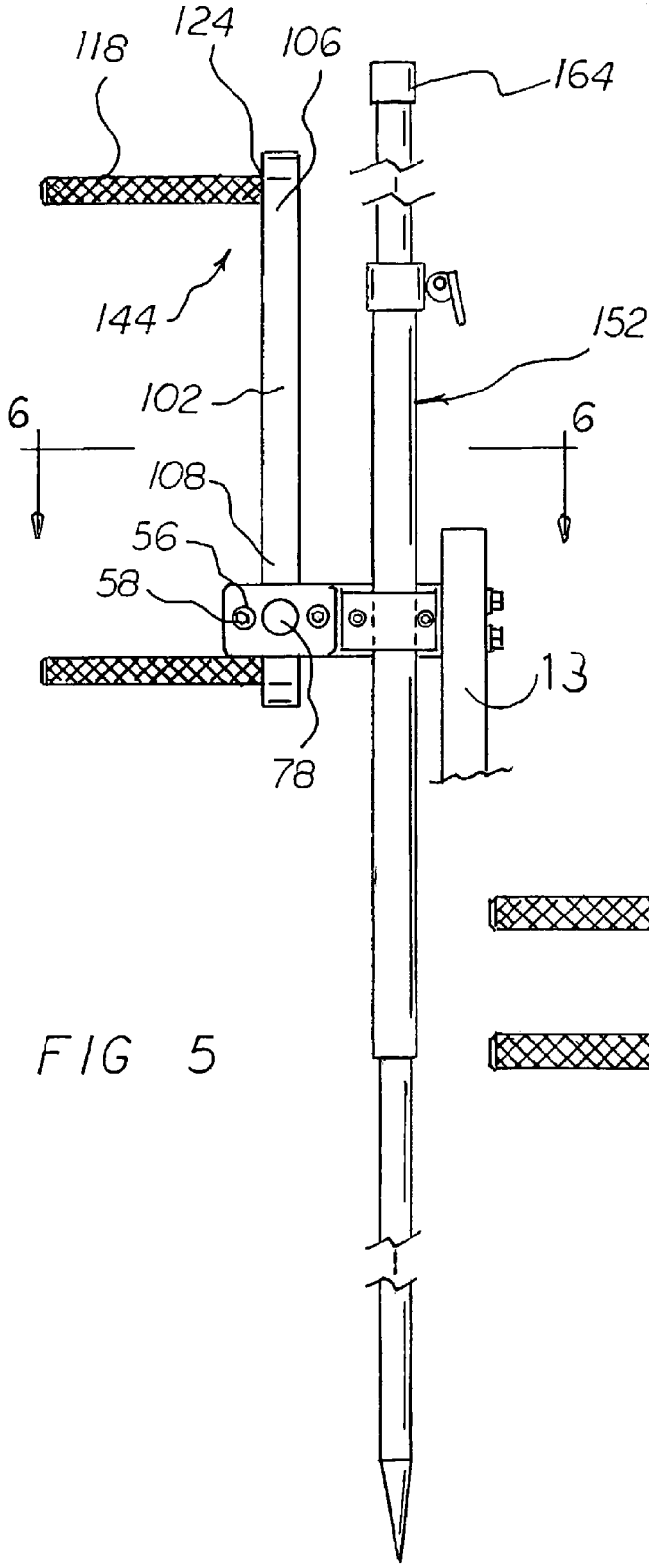
FIG. 5 is a side view of the jack plate ladder with the addition of the pole attachment. The pole attachment is used to anchor the boat in shallow water when fishing.
Figure 6:
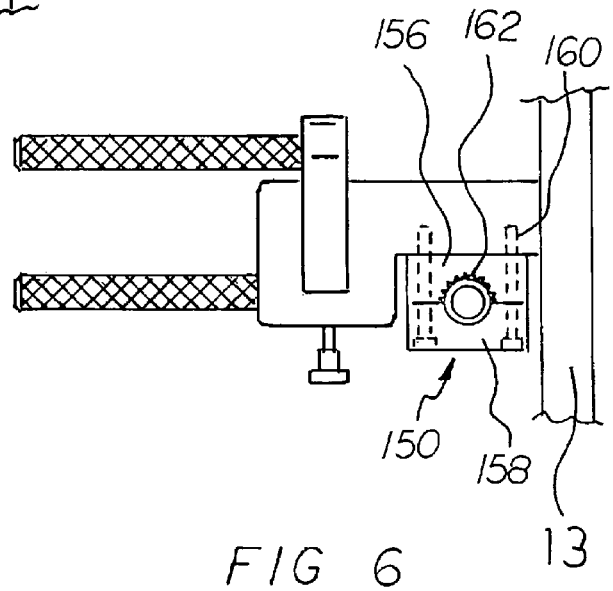
FIG. 6 is a view taken along line 6-6 of FIG. 5.

With reference now to the drawings, and in particular to FIG. 1 thereof, the preferred embodiment of the new and improved jack plate ladder embodying the principles and concepts of the present invention and generally designated by the reference numeral 10 will be described.

The present invention, the jack plate ladder 10 is comprised of a plurality of components. Such components in their broadest context include a jack plate mount, a ladder containment piece and a ladder. Such components are individually configured and correlated with respect to each other so as to attain the desired objective.

First provided is a jack plate mount 12 which is coupled to an existing jack plate 13. The jack plate mount is fabricated of a rigid material. The jack plate mount has a plate end 14 and a ladder mount end 16. The plate end has a solid rectilinear configuration with a generally rectilinear cross sectional configuration. The plate end has an outermost extent 18, with the outermost extent having a plurality of threaded bolt holes 20 there in. The bolt holes each have an associated bolt 22 and lock washer 24 there with.

The ladder end is continuous with the plate end of the jack plate mount. The ladder end has an outermost extent 30, with the extent comprising a generally rectilinear solid shaft having a ladder groove 32 therein. The ladder end has a pair of threaded ladder mount bolt holes 34 there in.

There is provided a ladder containment piece 40. The containment piece has a generally C-shaped configuration, with two short legs 42 each having a first length and a connector 44 having a second length there between. The short legs of the ladder containment are shorter than the connector second length. The ladder containment piece has an upper surface 46, a lower surface 48, and a side surface 50 there between. The ladder containment piece also has an inner surface 52. The side surface of the ladder containment piece has a pair of ladder mount bolt holes 54 there through.

The ladder mount bolt holes run from the side surface of the containment, through the length of the short legs of the containment, to the inner surface of the containment. Each ladder mount bolt hole has an associated ladder mount bolt 56 and an associated lock washer 58.

The ladder end and the ladder containment are coupled by the ladder mount bolts, thereby forming a generally rectilinear ladder aperture 60 through the ladder end of the jack plate mount.

The containment has an associated lock pin 70. The lock pin having an associated biasing spring 72, and spring stop 74. The lock pin has a shaft 76 and a knurled gripping knob 78. The containment has a lock pin aperture 80 there through. The lock pin aperture has an associated spring recess 82 located on the inner surface of the containment. The lock pin aperture runs from the side surface of the containment to the inner surface of the containment, with the lock pin passing through the lock pin aperture.

The containment also has a threaded grease fitting hole 90 located on the upper surface of the containment. The grease fitting hole passes from the upper surface of the containment to the lock pin aperture. The grease fitting hole has an associated grease fitting 92 coupled there to.

There is provided a ladder 100. The ladder is fabricated of a rigid material. The ladder having a central shaft 102 and a pair of steps 104. The central shaft has a generally rectilinear configuration, with an upper end 106 and a lower end 108. The upper end an upper extent 110 and a lower end has a lower extent 112. The upper end has a step bolt hole 114 there through. The lower end has a step bolt hole 116 there through. The steps each have a generally round tubular construction, with each step having an outer end 118 and an inner end 120. The outer end of the step has an outer extent 122 and the inner end of the step has an inner extent 124. The inner extent of each of the steps has a threaded bolt hole 126 there in. Each step has an associated coupling bolt 128 and lock washer 130. The steps each operatively couple to the ladder central shaft.

The central shaft of the ladder passes through and is contained within the ladder aperture 140 formed by the mount end and ladder containment piece. The lower end of the ladder central shaft has a lock pin recess 142 therein. The lock pin recess engages the lock pin and maintains the ladder in an upwardly displaced and stored orientation 144. The pulling of the lock pin by the user allows the ladder to fall downward, through the ladder aperture, to a downward, deployed position 146.

The jack plate mount may, in a variation of this configuration, have an associated pole mount 150 and pole 152. In this variation, the plate end of the jack plate mount has a pair of threaded bolt holes 154 there into. The pole mount is a two piece pole holder, having a first piece being the base 156, and a second piece being the cap 158. The base has a generally C-shaped configuration, and the cap has a generally C-shaped configuration. The base and the cap each have a pair of continuous bolt holes 160 162 there through. The base and cap form an aperture through the combined mount. The pole, used for anchoring is inserted through the mount. The pole has a cap flange 164, which prevents the pole from falling through the mount aperture.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be'encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A jack plate ladder comprising, in combination:

a jack plate mount having a ladder groove and a pair of threaded ladder mount bolt holes and a pair of threaded plate mounting holes there in;

a ladder containment piece, being coupled by a plurality of ladder mount bolts to the jack plate mount and thereby forming a generally rectilinear ladder aperture with the jack plate mount;

a ladder having a single shaft and a pair of steps, the jack plate mount having a plate end and a ladder mount end, the plate end having the pair of threaded bolt holes there in with the bolt holes each having an associated bolt and lock washer there with;

the containment piece having a generally C-shaped configuration with two short legs each having a first length and a connector located between and coupling the short legs, the connector having a second length; and the ladder single shaft having an upper end with an upper extent and a lower end with a lower extent, the upper end having a step bolt hole there through and the lower end having a step bolt hole there through, the single shaft of the ladder passing through and being contained within the ladder aperture formed by the mount end and ladder containment piece.

2. The jack plate ladder as described in claim 1 with the jack plate ladder further comprising:

the ladder end of the jack plate mount comprising a generally rectilinear solid shaft and being continuous with the plate end of the jack plate mount, the ladder end having an outermost extent;

the short legs of the ladder containment being shorter than the connector second length, the ladder containment having an upper surface and a lower surface and a side surface there between, the ladder containment also having an inner surface, the side surface of the ladder containment piece having a pair of ladder mount bolt holes there through, the containment having an associated lock pin with the lock pin having a shaft and a knurled gripping knob and a biasing spring and a stop, the containment having a lock pin aperture there through; and the ladder single shaft having a generally rectilinear configuration with the ladder steps each having a generally round rectilinear construction.

3. The jack plate ladder as described in claim 2 with the jack plate ladder further comprising:

the plate end of the jack plate mount having a solid rectilinear configuration with a generally rectilinear cross sectional configuration, the plate end having an outermost extent;

the containment ladder mount bolt holes running from the side surface of the containment through the length of the short legs of the containment to the inner surface of the containment with each hole having an associated ladder mount bolt and lock washer, the lock pin aperture of the containment running from the side surface of the containment to the inner surface of the containment with the lock pin passing through the lock pin aperture;

each ladder step having an outer end with an outer extent and an inner end with an inner extent, the inner extent of each of the steps having a threaded bolt hole there in, the steps each being operatively coupled to the ladder shaft.

4. The jack plate ladder as described in claim 3 with the jack plate ladder further comprising:

the jack plate mount being fabricated of a rigid material;

the ladder being fabricated of a rigid material;

the containment also having a threaded grease fitting hole located on the upper surface of the containment, the grease fitting hole passing from the upper surface of the containment to the lock pin aperture, the grease fitting hole having an associated grease fitting coupled there to, the lock pin aperture in the containment having an associated lock pin spring recess, with the lock pin stop having a retaining pin;

each ladder step having an associated coupling bolt and lock washer for coupling the step to the ladder shaft, each ladder step having a knurled surface; and the lower end of the ladder shaft having a lock pin recess therein, the lock pin recess engaging the lock pin and maintaining the ladder in an upwardly displaced and stored orientation, the pulling of the lock pin by the user allowing the ladder to fall downward, through the ladder aperture to a downward, deployed position.

* * * * *